US009394589B2

(12) United States Patent
Kuwagaki

(10) Patent No.: US 9,394,589 B2
(45) Date of Patent: Jul. 19, 2016

(54) NI-SI-CO COPPER ALLOY AND MANUFACTURING METHOD THEREFOR

(75) Inventor: Hiroshi Kuwagaki, Ibaraki (JP)

(73) Assignee: JX Nippon Mining & Metals Corporation

( * ) Notice: Subject to any disclaimer, the term of this patent is extended or adjusted under 35 U.S.C. 154(b) by 1064 days.

(21) Appl. No.: 13/139,266

(22) PCT Filed: Dec. 11, 2009

(86) PCT No.: PCT/JP2009/070753

§ 371 (c)(1),
(2), (4) Date: Jun. 21, 2011

(87) PCT Pub. No.: WO2010/067863

PCT Pub. Date: Jun. 17, 2010

(65) Prior Publication Data

US 2011/0240182 A1 Oct. 6, 2011

(30) Foreign Application Priority Data

Dec. 12, 2008 (JP) ..... 2008-317217

(51) Int. Cl.

| | |
|---|---|
| ***C22C 9/00*** | (2006.01) |
| ***C22C 9/06*** | (2006.01) |
| ***C22F 1/08*** | (2006.01) |
| ***H01B 1/02*** | (2006.01) |

(52) U.S. Cl.
CPC ... *C22C 9/06* (2013.01); *C22F 1/08* (2013.01); *H01B 1/026* (2013.01)

(58) Field of Classification Search
CPC ..... C22F 1/08; C22C 9/00; C22C 9/06; C22C 9/10
USPC ..... 148/411, 682
See application file for complete search history.

(56) References Cited

U.S. PATENT DOCUMENTS

| | | | | |
|---|---|---|---|---|
| 7,090,732 | B2 * | 8/2006 | Usami et al. | 148/433 |
| 7,182,823 | B2 | 2/2007 | Mandigo et al. | 148/435 |

(Continued)

FOREIGN PATENT DOCUMENTS

| | | | |
|---|---|---|---|
| EP | 2 157 199 | 2/2010 | C22C 9/00 |
| JP | 2005-532477 A | 10/2005 | |

(Continued)

OTHER PUBLICATIONS

European Search Report dated Jun. 4, 2010 from corresponding European application No. 09831966.8.

*Primary Examiner* — Devang R Patel
(74) *Attorney, Agent, or Firm* — Drinker Biddle & Reath LLP

(57) ABSTRACT

Disclosed is a Ni—Si—Co copper alloy that is suitable for use for various kinds of electronic parts and has particularly good uniform plating adhesion properties. The copper alloy for electronic materials comprises Ni: 1.0-2.5 mass %, Co: 0.5-2.5 mass % and Si: 0.3-1.2 mass % and the remainder is made of Cu and unavoidable impurities. For the copper alloy for electronic materials, the mean crystal size, at the plate thickness center, is 20 μm or less, and there are five or fewer crystal particles that contact the surface and have a long axis of 45 μm or greater per 1 mm rolling direction length. The copper alloy may comprise a maximum of 0.5 mass % Cr and may comprise a maximum in total of 2.0 mass % of one, two or more selected from a group comprising Mg, P, As, Sb, Be, B, Mn, Sn, Ti, Zr, Al, Fe, Zn and Ag.

3 Claims, 3 Drawing Sheets

25 μm

(56) References Cited

U.S. PATENT DOCUMENTS

| | | | | |
|---|---|---|---|---|
| 7,338,631 | B2 * | 3/2008 | Ishida et al. | 420/492 |
| 8,268,098 | B2 * | 9/2012 | Aruga et al. | 148/412 |
| 2004/0079456 | A1 | 4/2004 | Mandigo et al. | 148/554 |
| 2005/0263218 | A1 * | 12/2005 | Tanaka | C22C 9/06 148/433 |
| 2007/0131315 | A1 * | 6/2007 | Mandigo et al. | 148/435 |
| 2008/0047634 | A1 * | 2/2008 | Mihara et al. | 148/414 |
| 2008/0056930 | A1 * | 3/2008 | Ito et al. | 420/477 |
| 2009/0183803 | A1 * | 7/2009 | Mutschler et al. | 148/554 |

FOREIGN PATENT DOCUMENTS

| | | | |
|---|---|---|---|
| JP | 2006-037237 | A | 1/2006 |
| JP | 2007-169765 | A | 7/2007 |
| JP | 2008-248333 | A | 10/2008 |
| JP | 2008-266783 | A | 11/2008 |
| JP | 2008-266787 | A | 11/2008 |

* cited by examiner

25 μm

25 μm

25 μm

25 μm

25 μm

25 μm

NI-SI-CO COPPER ALLOY AND MANUFACTURING METHOD THEREFOR

TECHNICAL FIELD

The present invention relates to a Ni—Si—Co copper alloy which is a precipitation hardened copper alloy suitable for use in various electronic parts, in particular, the present invention relates to a Ni—Si—Co copper alloy having excellent uniform plating adhesion property.

BACKGROUND ART

As for copper alloys for electronic materials used in various electronic parts such as connectors, switches, relays, pins, terminals, lead frames etc., it is desired to satisfy both high strength and high electrical conductivity (or thermal conductivity) as basic properties. In recent years, high integration as well as reduction in size and thickness of electronic parts have rapidly advanced, and in correspondence with the foregoing advancements, the desired level for copper alloys used in electronic device parts are becoming increasingly sophisticated.

In regards to high strength and high electrical conductivity, the amount of precipitation hardened copper alloy used as the copper alloy for electronic materials, in place of solid solution strengthened copper alloys such as conventional phosphor bronze and brass, have been increasing. In precipitation hardened copper alloys, microfine precipitates uniformly disperse by age-treating of a solutionized supersaturated solid solution to increase alloy strength, and at the same time the amount of solutionized element in copper decrease to improve electrical conductivity. As a result, a material having excellent mechanical characteristics such as strength and spring property as well as good electrical and thermal conductivity is obtained.

Among precipitation hardened copper alloys, a Ni—Si copper alloy generally referred to as the Corson alloy is a representative copper alloy that possesses the combination of relatively high electrical conductivity, strength, and bending workability, making it one of the alloys that are currently under active development in the art. In this copper alloy, improvement of strength and electrical conductivity is attempted by allowing microfine Ni—Si intermetallic compound particles to precipitate in the copper matrix.

In order to improve further properties of the Corson alloy, various technical developments such as addition of alloy components other than Ni and Si, exclusion of components that adversely affect properties, optimization of crystalline structure, and optimization of precipitation particles have been performed. For example, properties are known to be improved by addition of Co or by controlling second phase particles precipitating in the matrix, and recent improvement technologies on Ni—Si—Co copper alloys are listed below.

Japanese Translation of PCT International Application Publication No. 2005-532477 (patent document 1) describes controlling the amounts of Ni, Si, and Co and the relationship thereof in order to obtain Ni—Si—Co copper alloys having excellent bending workability, electrical conductivity, strength, and stress relaxation resistance. Average grain size of 20 μm or less is also described. The manufacturing step thereof is characterized in that the first age annealing temperature is higher than the second age annealing temperature (paragraphs 0045-0047).

Japanese Published Unexamined Patent Application Publication No. 2007-169765 (patent document 2) describes controlling coarsening of crystal grains by controlling the distribution of second phase particles in order to improve the bending workability of Ni—Si—Co copper alloys. In this patent document, for a copper alloy having cobalt added to the Corson alloy, the relationship between precipitates having the effect of controlling coarsening of crystal grains and its distribution in high temperature thermal treatment is clarified, and strength, electrical conductivity, stress relaxation property, and bending workability are improved by controlling the crystal grain size (paragraph 0016). The crystal grain size is the smaller, the better, and a size of 10 μm or less is said to improve bending workability (paragraph 0021).

Japanese Published Unexamined Patent Application Publication No. 2008-248333 (patent document 3) discloses a copper alloy for electronic materials having controlled generation of coarse second phase particles in the Ni—Si—Co copper alloy. This patent document describes that controlling the generation of coarse second phase particles by hot rolling and solutionizing under particular conditions will allow for realization of the target superior property (paragraph 0012).

Patent Document 1: Japanese Translation of PCT International Application Publication No. 2005-532477.

Patent Document 2: Japanese Published Unexamined Patent Application Publication No. 2007-169765.

Patent Document 3: Japanese Published Unexamined Patent Application Publication No. 2008-248333.

DISCLOSURE OF THE INVENTION

Problems to be Solved by the Invention

Copper alloys for electronic materials used in various electronic parts such as connectors, switches, relays, pins, terminals, lead frames etc. are typically plated with Au in many cases. In such cases, it is common to employ Ni plating as an undercoating. These Ni undercoats have also become thinner in correspondence with recent reduction in size and thickness of electronic parts.

Accordingly, a deficiency in Ni plating which has not been a problem until now, in particular, the deficiency that Ni plating is partially not uniformly adhered has surfaced.

Copper alloys described in the above patent documents 1-3 are all described in terms of crystal grain size, but variation of crystal grain size in depth direction, particularly the relationship between coarse crystals formed at the surface and adhesion of plating is not noted in any way.

The problem to be solved by the present invention is to provide an undercoat, in particular a Ni—Si—Co copper alloy onto which Ni plating can uniformly adhere.

Means for Solving the Problems

The present inventors have performed intensive and extensive research to solve the above problems. As a result, we have found that due to the presence of coarsening crystal at the surface, the surface layer of the Ni—Si—Co copper alloy is more prone to local coarsening of crystal grain size than the interior (plate thickness center), and platability (uniform adhesion of plating) will be reduced even if the overall average grain size is small. The present invention has the following components:

(1) A copper alloy for electronic materials characterized in that said copper alloy contains Ni: 1.0-2.5% by mass, Co: 0.5-2.5% by mass, Si: 0.3-1.2% by mass, and the remainder consists of Cu and unavoidable impurities, the average grain size at the plate thickness center is 20 μm or less, and wherein the number of crystal grains contacting the surface which have a major axis of 45 μm or greater is 5 or less per 1 mm in rolling direction length.

(2) The copper alloy for electronic materials according to (1), further contains up to 0.5% by mass of Cr.

(3) The copper alloy for electronic materials according to (1) or (2), further contains a total of up to 2.0% by mass of one or two or more selected from the group consisting of Mg, P, As, Sb, Be, B, Mn, Sn, Ti, Zr, Al, Fe, Zn and Ag.

(4) A method for manufacturing the copper alloy for electronic materials according to any of (1) to (3), comprising the following steps in the described order:

a step of fusion casting of an ingot;

a step of heating at a material temperature of 950-1050° C. for 1 hour or more, and then performing hot rolling, wherein the temperature after completion of hot rolling is 800° C. or above;

an intermediate rolling step before solution treatment wherein the last pass is performed with a reduction ratio of 8% or more;

an intermediate solution treatment step of heating at a material temperature of 950-1050° C. for 0.5 minutes to 1 hour;

a final rolling step with a reduction ratio of 20-50%; and an aging step.

Figure 1:
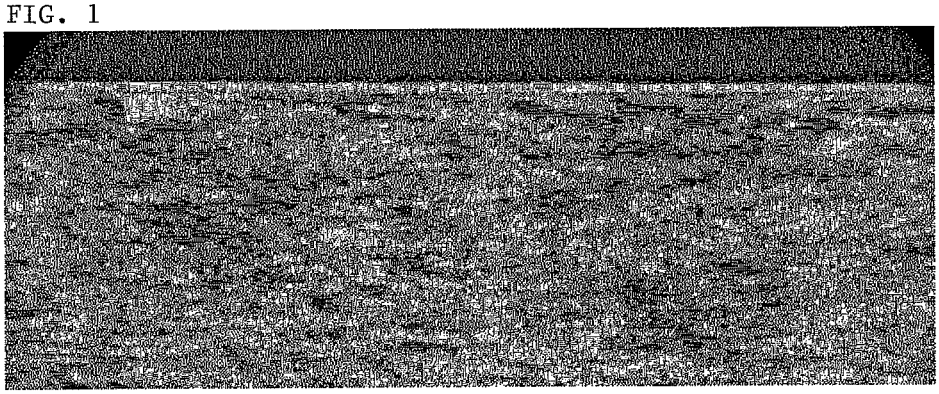
FIG. 1 is a microscope photograph (magnification: ×400) showing the surface layer cross-section in the rolling direction of the copper alloy of the present invention (Example 1, after Ni plating)

BEST MODE FOR CARRYING OUT THE INVENTION (1) Addition Amounts of Ni, Co and Si The added Ni, Co and Si form an intermetallic compound within the copper alloy by an appropriate thermal treatment, and high strengthening can be attempted by a precipitation strengthening effect without deteriorating electrical conductivity, in spite of the existence of added elements other than copper.

Desired strength cannot be obtained if any of the addition amounts of Ni, Co and Si are, Ni is less than 1.0% by mass, Co is less than 0.5% by mass, or Si is less than 0.3% by mass. On the other hand, when Ni is more than 2.5% by mass, Co is more than 2.5% by mass, or Si is more than 1.2% by mass, high strengthening can be attempted but electrical conductivity is significantly reduced, and further, hot working capability is deteriorated. The addition amounts of Ni, Co and Si are therefore set at Ni: 1.0-2.5% by mass, Co: 0.5-2.5% by mass, and Si: 0.3-1.2% by mass. The addition amounts of Ni, Co and Si are preferably as Ni is 1.5-2.0% by mass, Co is 0.5-2.0% by mass, and Si is 0.5-1.0% by mass.

(2) Addition Amount of Cr

In the cooling process during fusion casting, Cr can strengthen the crystal grain boundary, allowing for less generation of cracks during hot working, and inhibiting the reduction of yield during manufacture, because Cr preferentially precipitates at the grain boundary. In other words, Cr that underwent grain boundary precipitation during fusion casting will be resolutionized by for example solutionizing, but forms precipitation particles of bcc structure having Cr as the main component or forms a compound with Si (silicide) during the subsequent aging precipitation. In an ordinary Ni—Si copper alloy, of the amount of Si added, Si that did not contribute to aging precipitation will remain solutionized in the matrix and become the cause of reduction in electrical conductivity. Silicide-forming element Cr is therefore added, and Si that did not contribute to aging precipitation is further precipitated as silicide resulting in decrease in the amount of solutionized Si, and reduction in electrical conductivity can be prevented without any loss in strength. However, when Cr concentration is more than 0.5% by mass, coarse second phase particles tend to form and thus, product property is deteriorated. Accordingly, up to 0.5% by mass of Cr can be added to the Ni—Si—Co copper alloy according to the present invention. However, since less than 0.03% by mass will only have a small effect, preferably 0.03-0.5% by mass, more preferably 0.09-0.3% by mass may be added.

(3) Addition Amounts of Third Elements a) Addition Amounts of Mg, Mn, Ag and P

Mg, Mn, Ag and P will improve product properties such as strength and stress relaxation property without any loss of electrical conductivity with addition of just a trace amount. The effect of addition is mainly exerted by solutionizing into the matrix, but further effect can also be exerted by being contained in second phase particles. However, when the total concentration of Mg, Mn, Ag and P is more than 2.0% by mass, the effect of improving the property will reach a plateau and in addition manufacturability will be deteriorated. Accordingly, it is preferred to add a total of up to 2.0% by mass of one or two or more selected from Mg, Mn, Ag and P to the Ni—Si—Co copper alloy according to the present invention. However, since less than 0.01% by mass will only have a small effect, more preferably a total of 0.01-2.0% by mass, even more preferably a total of 0.02-0.5% by mass, typically a total of 0.04-0.2% by mass is added.

b) Addition Amounts of Sn and Zn

Sn and Zn will also improve product properties such as strength, stress relaxation property, and platability without any loss of electrical conductivity with addition of just a trace amount. The effect of addition is mainly exerted by solutionizing into the matrix. However, when the total concentration of Sn and Zn is more than 2.0% by mass, the effect of improving the property will reach a plateau and in addition manufacturability will be lost. Accordingly, a total of up to 2.0% by mass of one or two selected from Sn and Zn can be added to the Ni—Si—Co copper alloy according to the present invention. However, since less than 0.05% by mass will only have a small effect, preferably a total of 0.05-2.0% by mass, more preferably a total of 0.5-1.0% by mass may be added.

c) Addition Amounts of As, Sb, Be, B, Ti, Zr, Al and Fe

As, Sb, Be, B, Ti, Zr, Al and Fe will also improve product properties such as electrical conductivity, strength, stress relaxation property, and platability by adjusting the addition amount according to the desired product property. The effect of addition is mainly exerted by solutionizing into the matrix, but further effect can also be exerted by being contained in second phase particles, or by forming second phase particles of new composition. However, when the total of these elements is more than 2.0% by mass, the effect of improving the property will reach a plateau and in addition manufacturability will be lost. Accordingly, a total of up to 2.0% by mass of one or two or more selected from As, Sb, Be, B, Ti, Zr, Al and Fe can be added to the Ni—Si—Co copper alloy according to the present invention. However, since less than 0.001% by mass will only have a small effect, preferably a total of 0.001-2.0% by mass, more preferably a total of 0.05-1.0% by mass is added.

Since manufacturability is prone to be lost when the above-described addition amounts of Mg, P, As, Sb, Be, B, Mn, Sn, Ti, Zr, Al, Fe, Zn and Ag in total exceed 2.0% by mass, preferably the total of these is 2.0% by mass or less, more preferably 1.5% by mass or less, and even more preferably 1.0% by mass or less.

(4) Crystal Grain Size

It is conventionally known that high strength is obtained when crystal grain size is small. In the present invention, the average grain size at the plate thickness center of the cross-section in the rolling direction is 20 μm or less. Here, the average grain size at the plate thickness center is measured based on JIS H 0501 (method of section). No significant relative change in average grain size at the plate thickness center of the copper alloy of the present invention is produced for before and after final rolling with a reduction ratio of 20-50%. Accordingly, if the average grain size is 20 μm or less before final rolling, a crystal structure finer than the sample copper alloy having an average grain size of 20 μm is maintained even after final rolling. For this reason, even if the crystal structure is too fine and the average grain size after final rolling cannot be numerically measured with precision, by subjecting a control sample having an average grain size of 20 μm before final rolling to final rolling under the same condition and using this as a standard for comparison, it can be decided whether or not the average grain size exceeds 20 μm. Further, "average grain size of 20 μm or less at the plate thickness center" as used herein is a definition set to guarantee high strength similar to the prior art, and "plate thickness center" is terms to show the location of measurement.

In prior art, variation in crystal grain size, in particular coarsening crystals at the surface have not especially attracted attention, and it was completely unknown that coarsening crystal grains at the surface have an adverse effect on uniform plating adhesion property. However, the surface layer is the most likely the point in the rolling step to accumulate strain energy, and under ordinary manufacturing conditions crystals at the surface layer tend to coarsen locally than in the interior (plate thickness center). In addition, thermal history may also differ between the surface layer and the interior in the thermal treatment step, and crystals at the surface layer may coarsen locally more than in the interior (plate thickness center). In such cases, "surface layer" as used herein refers to a range of 25 μm from the surface.

The present inventors have found that a copper alloy for electronic materials onto which the plating uniformly adheres can be obtained by reducing coarsened crystal grains at the surface of the Ni—Si—Co copper alloy.

Specifically, the number of crystal grains contacting the surface which have a major axis of 45 μm or greater after final rolling is 5 or less, preferably 4 or less, further preferably 2 or less per 1 mm in rolling direction length. If there are more than 5, the plating will not adhere uniformly, and a defective product where dull deposit is generated on the plating surface as observed by the naked eye is produced.

In addition, for the number of crystal grains, in a microscope photograph (magnification: ×400), the number of crystal grains of 45 μm or greater contacting the surface of the cross-section in the rolling direction is counted, and the number of crystal grains is divided by the sum within the range of the 2000 μm length of the surface in multiple (10 times) measurement fields, to obtain the 1 mm unit.

Since the copper alloy of the present invention has 5 or less crystal grains having a major axis of 45 μm or greater at the surface, it has excellent uniform plating adhesion property. Various plating materials can be applied for the copper alloy of the present invention, for example, including Ni undercoat typically used as the undercoating for Au plating, Cu undercoat, and Sn plating.

The plating thickness of the present invention is, needless to say, the typically used thickness of 2-5 μm, and a thickness of 0.5-2.0 μm also show sufficient uniform adhesion property.

(5) Manufacturing Method

In the method for manufacturing the copper alloy of the present invention, a manufacturing process (fusion and casting->hot rolling->intermediate cold rolling->intermediate solutionizing->final cold rolling->aging) common for copper alloys will be used. The following conditions will be adjusted in the steps to manufacture the subject copper alloy. Note that intermediate rolling and intermediate solutionizing may be repeated multiple times as necessary.

In the present invention, it is important to strictly control the conditions for hot rolling, intermediate cold rolling, and intermediate solutionizing. Reasons for this are that Co which will make the second phase particles more prone to coarsening is added to the copper alloy of the present invention, and that the production and growth speed of second phase particles are largely affected by the holding temperature and cooling speed during thermal treatment.

In the fusion and casting step, materials such as electrolytic copper, Ni, Si, and Co are fused to obtain a molten metal of desired composition. Then, this molten metal is cast into ingot. In the subsequent hot rolling, uniform thermal treatment is performed, and it is necessary to eliminate as much as possible crystallizations such as Co—Si and Ni—Si generated in casting. For example, hot rolling is performed after holding at 950° C. to 1050° C. for 1 hour or more. Solutionizing will be insufficient if the holding temperature before hot rolling is below 950° C., while material may melt if it exceeds 1050° C.

In addition, if the temperature at completion of hot rolling is below 800° C., this means that the processing in the last pass of hot rolling or several passes including the last pass was done below 800° C. If the temperature at completion of hot rolling is below 800° C., the process will have finished with the interior in a recrystallized state while the surface layer will have undergone processing strain. When this is subjected in this state to cold rolling and solutionizing under ordinary condition, the interior will have normal recrystallized structure while coarsened crystal grains will form at the surface layer. Accordingly, in order to prevent the formation of coarsening crystals at the surface layer, it is desirable to complete hot rolling at 800° C. or above, preferably 850° C. or above, and rapid cooling is desirable after completion of hot rolling. Rapid cooling can be achieved by water cooling.

After hot rolling, intermediate rolling and intermediate solutionizing will be performed by appropriately selecting the number of times repeated and the sequential order within a target range. If the reduction ratio of the last pass of intermediate rolling is less than 5%, processing strain energy will be accumulated only on the material surface, and thus coarse crystal grains will be generated at the surface layer. In particular, intermediate rolling reduction ratio for the last pass is preferably 8% or more. In addition, controlling the viscosity of rolling oil used for intermediate rolling and the speed of intermediate rolling are also effective in applying uniform processing strain energy.

The intermediate solutionizing is sufficiently performed to eliminate as much as possible precipitates such as coarse Co—Si and Ni—Si by solutionizing crystallized particles during fusion casting or precipitation particles after hot rolling. For example, solutionizing will be insufficient if the solutionizing temperature is below 950° C., and desired strength cannot be obtained. On the other hand, the material may melt if the solutionizing temperature exceeds 1050° C. Accordingly, it is preferred to perform solutionizing where heating is performed with a material temperature of 950° C. to 1050° C. Solutionizing time is preferably 60 seconds to 1 hour.

In relation to temperature and time, in order to obtain the same thermal treatment effect (for example the same crystal grain size), in common sense, the time needs to be shorter for a higher temperature and longer for a lower temperature. For example, in the present invention, 1 hour is desirable for 950° C. and 2 or 3 minutes to 30 minutes is desirable for 1000° C.

The cooling speed following to solutionizing is generally rapid cooling to prevent precipitation of solutionized second phase particles.

The reduction ratio of final rolling is preferably 20-50%, preferably 30-50%. Desired strength cannot be obtained with less than 20%. On the other hand, bending workability will deteriorate above 50%.

The final aging step of the present invention is done similar to prior art and microfine second phase particles are uniformly precipitated.

Coarse crystal particles do not exist at the surface of the copper alloy of the present invention, and thus it has excellent uniform plating adhesion property and can be suitably used in electronic parts such as lead frames, connectors, pins, terminals, relays, switches, and foil for rechargeable battery.

EXAMPLES

Examples of the present invention will be shown below together with Comparative Examples. However, these Examples are provided for better understanding of the present invention and its advantages, and not intended to limit the invention.

Figure 4:
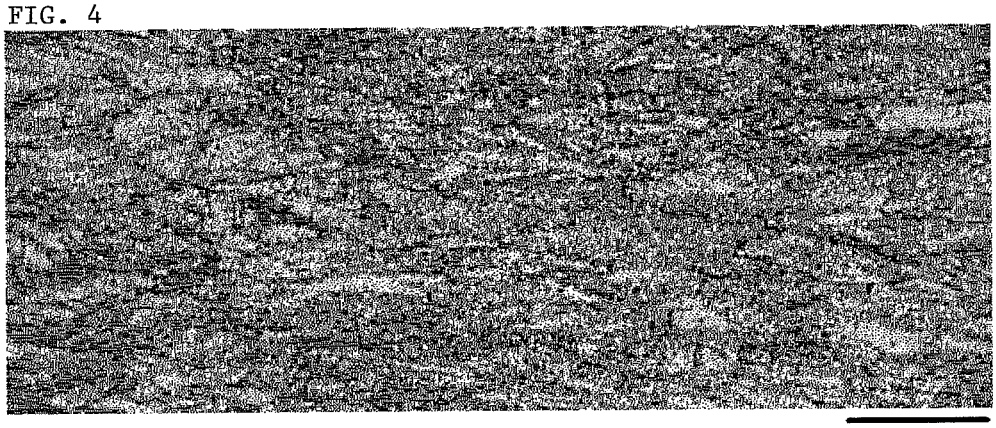
FIG. 4 is a microscope photograph (magnification: ×400) showing the plate thickness center after final rolling of the above standard sample.
Figure 5:
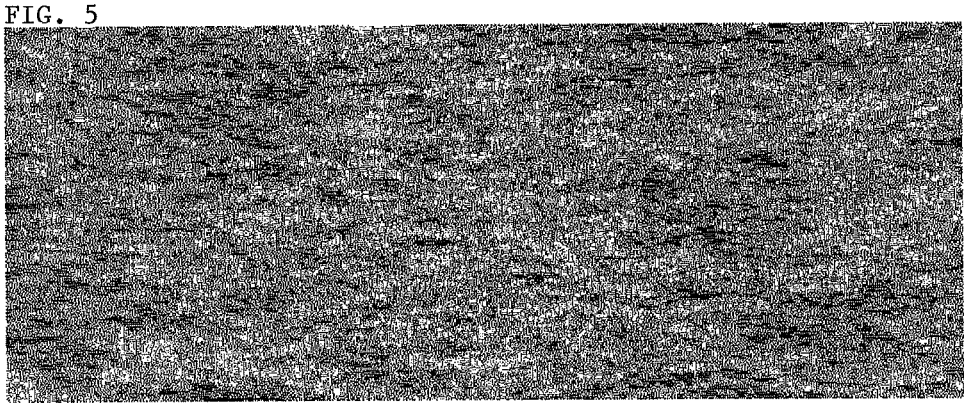
FIG. 5 is a microscope photograph (magnification: ×400) showing the plate thickness center after final rolling of the copper alloy of the present invention (Example 1)
Figure 6:
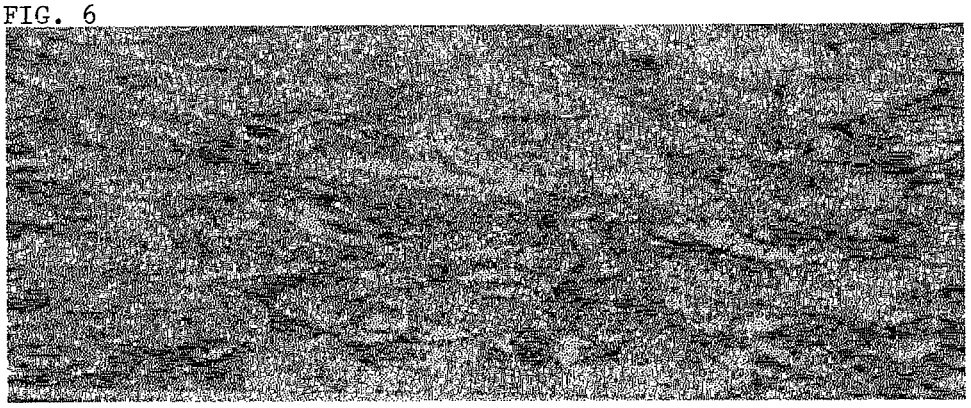
FIG. 6 is a microscope photograph (magnification: ×400) showing the plate thickness center after final rolling of the copper alloy of Comparative Example (Comparative Example 10)

(1) Method of Measurement (a) Crystal Grain Size at Plate Thickness Center:

A standard sample having an average grain size at the plate thickness center in the rolling direction of 20 μm after solutionizing and before final rolling was manufactured (Ni: 1.9% by mass, Co: 1.0% by mass, Si: 0.66% by mass, and the remainder is copper). The average grain size was measured based on JIS H 0501 (sectional method). The standard sample was subjected to final cold rolling (reduction ratio of 40%), and an optical microscope photograph (magnification: ×400, FIG. 4) of the plate thickness center of the cross-section in the rolling direction was taken as the standard. For each of the Examples (Examples and Comparative Examples), optical microscope photographs (same magnification as the standard) showing the plate thickness center after final cold rolling were visually compared with the standard for size, and indicated as greater than 20 μm (>20 μm) for larger and 20 μm or less (≤0.20 μm) for equivalent or smaller.

(b) Observation of Crystal Grains Close to Surface Layer

Figure 2:
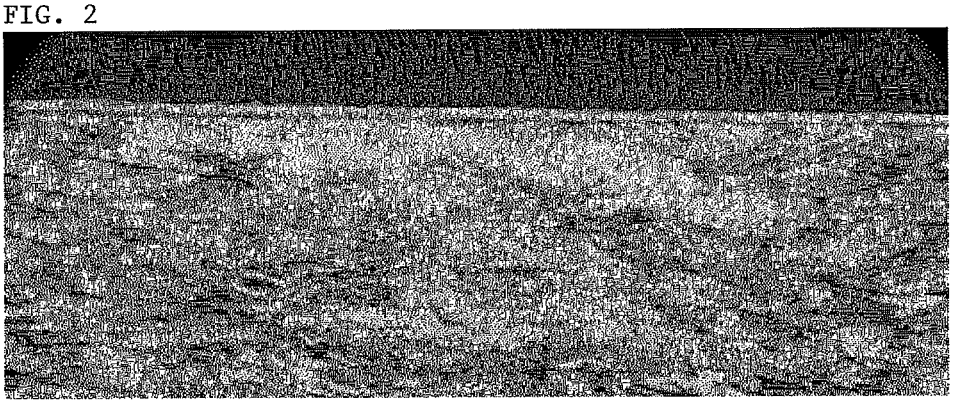
FIG. 2 is a microscope photograph (magnification: ×400) showing the surface layer cross-section in the rolling direction of the copper alloy of Comparative Example (Comparative Example 10, after Ni plating)
Figure 3:
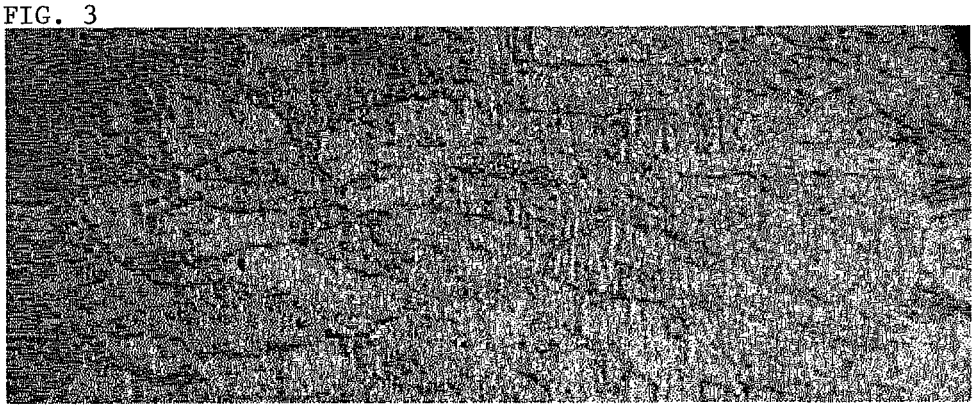
FIG. 3 is an optical microscope photograph (magnification: ×400) showing the plate thickness center after solutionizing and before final rolling in the rolling direction of the copper alloy standard sample of the present invention having average grain size of 20 μm (Ni: 1; 9% by mass, Co: 1; 0% by mass, Si: 0; 66% by mass, and the remainder is copper)

For the surface layer, using a microscope photograph showing the surface layer cross-section in the rolling direction, a line parallel to the surface was drawn at a location that is a depth of 10 μm from the surface layer, the length of the line was determined (segmented), and at the same time, using line segment method, the number of crystal grains having a size of 45 μm or greater that is at least partially in contact with the surface was determined in 10 fields. Then, the determined total number of crystal grains having a size of 45 μm or greater was divided by the total of line segment, and the number of crystal grain with size of 45 μm or greater per 1 mm was determined. As examples of a microscope photograph showing the surface layer cross-section in the rolling direction, the photographs of the following Example 1 and Comparative Example 10 are shown in FIGS. 1 and 2, respectively.

(c) Uniformity of Plating Adhesion (Electrolytic Degreasing Procedure)

Electrolytic degreasing employing the sample as a cathode in an aqueous alkali solution.

Acid washing with 10% by mass of aqueous sulfuric acid solution.

(Ni Undercoat Condition)

Plating bath composition: 250 g/L of nickel sulfate, 45 g/L of nickel chloride, and 30 g/L of boric acid Plating bath temperature: 50° C.

Current density: 5 A/dm$^2$

Ni plating thickness was adjusted by electrodeposition time to 1.0 μm. Measurement of plating thickness was carried out using coulometric thickness tester CT-1 (manufactured by Densoku Instruments Co., Ltd.) using electrolyte R-54 manufactured by Kocour.

(Assessment of Plating Adhesion Uniformity)

An optical microscope photograph (magnification: ×200, field area: 0.1 mm$^2$) of the plating surface was taken, the number and distribution of island platings were measured and observed. Assessment was as follows.

S: none;

A: the number of island platings was 50/mm$^2$ or less;

B: the number of island platings was 100/mm$^2$ or less; and

C: the number of island platings was more than 100/mm$^2$.

Figure 7:
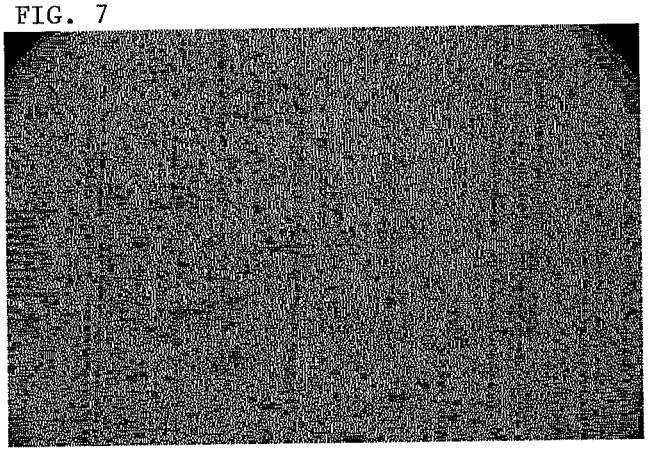
FIG. 7 is a microscope photograph (magnification: ×200) showing the plating surface of the Ni-plated copper alloy of the present invention (Example 1)
Figure 8:
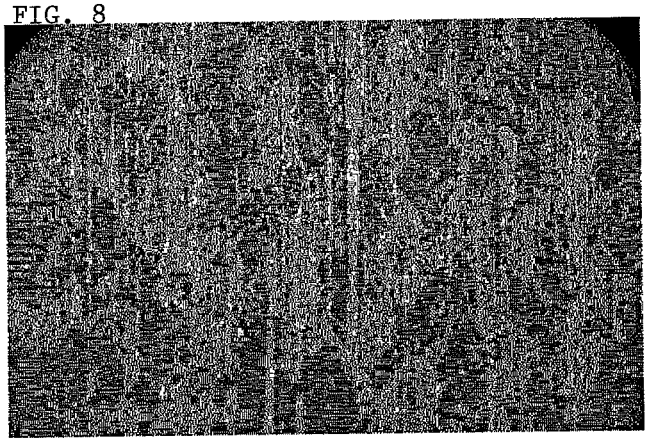
FIG. 8 is a microscope photograph (magnification: ×200) showing the plating surface of the Ni-plated copper alloy of Comparative Example (Comparative Example 10)
Figure 9:
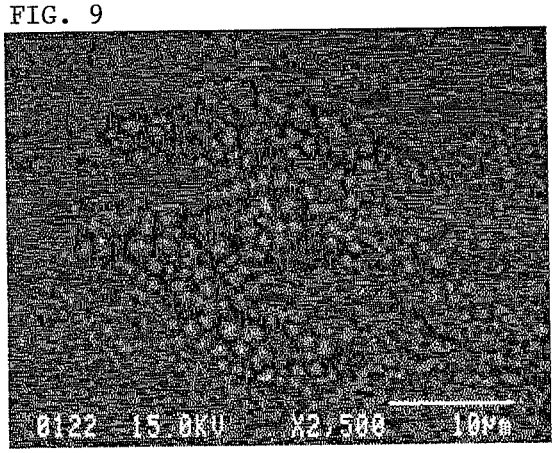
FIG. 9 is a magnified microscope photograph (magnification: ×2500) showing the plating surface of FIG. 8.

FIG. 7 shows the optical microscope photograph of the plating surface of Example 1 of the present invention, corresponding to rank "S", and FIG. 8 shows the optical microscope photograph of the plating surface of Comparative Example 10, corresponding to rank "C". In addition, FIG. 9 shows a magnified photograph (magnification: ×2500) of "island plating" observed on the plating surface. Such island is counted as one to measure the number of island platings within the field.

(d) Strength

Tensile test in the direction parallel to rolling was performed to measure 0.2% yield strength (YS: MPa).

(e) Electrical Conductivity (EC; % IACS)

This was determined by volume resistivity measurement by double bridge.

(f) Bending Workability

Following JIS H 3130, Badway (bending axis is the same direction as the rolling direction) W bend test was performed to measure the MBR/t value, i.e., the ratio of minimum radius without occurrence of cracking (MBR) to plate thickness (t). The bending workability was assessed with the following standard.

MBR/t≤2.0 Good 2.0<MBR/t Bad (2) Manufacturing Method

Copper alloys having each of the component compositions listed in Table 1 were melted at 1300° C. by a high frequency fusion furnace, and cast into ingots having a thickness of 30 mm. Subsequently, these ingots were heated for 3 hours under conditions listed in Table 1, after which they were set to the temperature at completion of hot rolling (finishing temperature) and hot rolled to 10 mm plates, and rapidly cooled with water to room temperature after completion of hot rolling. Then, after grinding to a thickness of 9 mm was performed to remove scales on the surface, cold rolling with 5-10% reduction ratio of last pass, and an intermediate solutionizing step with material temperature at 950-1000° C. for 0.5 minutes to 1 hour were appropriately carried out to obtain plates having a thickness of 0.15 mm. They were rapidly cooled with water cooling to room temperature after completion of solutionizing. The reduction ratio of final cold rolling was 40%. Next, aging treatment in an inert atmosphere at 450° C. for 3 hours was performed to obtain each test strip. Measurement result for each test strip is shown in Table 1. "-" in the Table below shows no addition.

TABLE 1

| | | Composition (% by mass) | | | | | Hot Rolling Condition | | |
|---|---|---|---|---|---|---|---|---|---|
| | No. | Ni | Co | Si | Cr | Others | Starting Temperature | Finishing Temperature | Last Pass reduction ratio % |
| Example | 1 | 1.9 | 1.0 | 0.66 | — | — | 950 | 850 | 10 |
| | 2 | 1.9 | 1.0 | 0.66 | — | — | 950 | 850 | 5 |
| | 3 | 1.9 | 1.0 | 0.66 | — | — | 950 | 820 | 10 |
| | 4 | 1.9 | 1.0 | 0.66 | 0.2 | — | 950 | 850 | 10 |
| | 5 | 1.9 | 1.0 | 0.66 | 0.2 | — | 950 | 850 | 5 |
| | 6 | 1.9 | 1.0 | 0.66 | 0.2 | — | 950 | 820 | 10 |
| | 7 | 1.9 | 1.0 | 0.66 | — | 0.1 Mg | 950 | 850 | 10 |
| | 8 | 1.9 | 1.0 | 0.66 | 0.2 | 0.5 Sn | 950 | 850 | 10 |
| Comparative Example | 9 | 1.9 | 1.0 | 0.66 | — | — | 950 | 850 | 10 |
| | 10 | 1.9 | 1.0 | 0.66 | — | — | 900 | 840 | 10 |
| | 11 | 1.9 | 1.0 | 0.66 | 0.2 | — | 900 | 790 | 10 |
| | 12 | 1.9 | 1.0 | 0.66 | 0.2 | — | 900 | 790 | 5 |
| | 13 | 1.9 | 1.0 | 0.66 | — | 0.1 Mg | 900 | 840 | 5 |
| | 14 | 1.9 | 1.0 | 0.66 | 0.2 | 0.5 Sn | 900 | 790 | 5 |

| | No. | Plate Thickness Center Average Crystal Grain Size | Number of Coarse Crystals on Surface/mm | Strength MPa | Electrical Conductivity % IACS | Bending workability | Plating Uniformity |
|---|---|---|---|---|---|---|---|
| Example | 1 | ≤20 μm | 0 | 865 | 47 | Good | S |
| | 2 | ≤20 μm | 1.2 | 860 | 47 | Good | A |
| | 3 | ≤20 μm | 3.1 | 850 | 48 | Good | B |
| | 4 | ≤20 μm | 0 | 875 | 48 | Good | S |
| | 5 | ≤20 μm | 0.8 | 870 | 48 | Good | A |
| | 6 | ≤20 μm | 3.1 | 860 | 49 | Good | B |
| | 7 | ≤20 μm | 0 | 895 | 45 | Good | S |
| | 8 | ≤20 μm | 0 | 890 | 46 | Good | S |
| Comparative Example | 9 | >20 μm | 0 | 825 | 47 | Bad | S |
| | 10 | ≤20 μm | 6.2 | 855 | 47 | Good | C |
| | 11 | ≤20 μm | 8.1 | 865 | 48 | Good | C |
| | 12 | ≤20 μm | 10.3 | 850 | 48 | Good | C |
| | 13 | ≤20 μm | 8.4 | 885 | 45 | Good | C |
| | 14 | ≤20 μm | 9.3 | 880 | 45 | Good | C |

Compared to the reduction ratio 10% of intermediate rolling in the last pass of Example 1, Example 2 having the same composition had one as low as 5%, thus coarse particles were generated at the surface, and uniform plating adhesion property was slightly poorer. The relationship between Examples 4 and 5 was similar.

Compared to the finishing temperature 850° C. (temperature at completion of hot rolling) of Example 1, Example 3 having the same composition had low 820° C., thus uniform plating adhesion property was poorer. The relationship between Examples 4 and 6 was similar.

Compared to the intermediate solutionizing temperature in the last pass of Example 1, 950° C. for 1 hour, Comparative Example 9 having the same composition, had high 1000° C. for 1 hour, thus the average grain size at the plate thickness center became greater than 20 μm and bending workability was poorer.

Compared to the hot rolling starting temperature 950° C. and the finishing temperature 850° C. of Example 1, Comparative Example 10 having the same composition had the temperature of as low as 900° C. and 840° C., thus coarse particles were generated at the surface and uniform plating adhesion property became poorer. When Ni plating was applied at 3.0 μm thickness on the copper alloy surface of Comparative Example 10, island platings were not notable on the surface after plating, making it's evaluation closer to rank "S".

The relationship between Example 4 and Comparative Example 11 was similar.

Compared to the reduction ratio 10% of intermediate rolling in the last pass of Comparative Example 11, Comparative Example 12 having the same composition had one was as low as 5%, thus coarse particles were further generated at the surface and uniform plating adhesion property became poorer.

Compared to the hot rolling starting temperature 950° C., the finishing temperature 850° C., and the reduction ratio of intermediate rolling in the last pass 10% of Example 7, Comparative Example 13 having the same composition had ones as low as 900° C., 840° C., and 5% respectively, thus coarse particles were generated at the surface and uniform plating adhesion property became poorer. The relationship between Example 8 and Comparative Example 14 was similar.

The invention claimed is:

1. A copper alloy for electronic materials characterized in that said copper alloy contains Ni: 1.0-2.5% by mass, Co: 0.5-2.5% by mass, Si: 0.3-1.2% by mass, Cr: 0.09 to 0.5% by mass, and the remainder consisting of Cu and unavoidable impurities, wherein the average grain size at the plate thickness center is 20 μm or less, and wherein the number of crystal grains contacting the surface which have a major axis of 45 μm or greater is 5 or less per 1 mm in a rolling direction length, said rolling direction length being the direction in which the copper alloy was rolled during formation from an ingot.

2. A method for manufacturing the copper alloy for electronic materials according to claim 1, comprising the following steps in the described order:

a step of fusion casting of an ingot;

a step of heating at a material temperature of 950-1050° C. for 1 hour or more, and then performing hot rolling, wherein the temperature after completion of hot rolling is 800° C. or above;

an intermediate cold rolling step before solution treatment wherein the last pass is performed with a reduction ratio of 8% or more;

an intermediate solutionizing step of heating at a material temperature of 950-1050° C. for 0.5 minutes to 1 hour;

a final rolling step with a reduction ratio of 20-50%; and an aging step.

3. The copper alloy for electronic materials according to claim 1, wherein IACS is 45% or more.

* * * * *